United States Patent [19]

Bauer

[11] 3,936,992

[45] Feb. 10, 1976

[54] MACHINE FOR FILLING CARRYING TRAYS WITH OBJECTS DISPOSED IN GROUPS

[76] Inventor: Everhard Bauer, Oberer Frankfurter Weg 21, 479. Paderborn, Germany

[22] Filed: May 8, 1974

[21] Appl. No.: 468,169

[30] Foreign Application Priority Data

May 10, 1973 Germany ..... 2323728

[52] U.S. Cl. ..... 53/162

[51] Int. Cl.[2] ..... B65B 35/30

[58] Field of Search ..... 53/162

[56] References Cited

UNITED STATES PATENTS

| | | | |
|---|---|---|---|
| 2,738,116 | 3/1956 | Barraclough | 53/162 X |
| 2,828,594 | 4/1958 | Webb et al. | 53/162 |
| 3,531,905 | 10/1970 | Omori | 53/162 X |
| 3,594,977 | 7/1971 | Grasvoll | 53/162 |

FOREIGN PATENTS OR APPLICATIONS

| | | | |
|---|---|---|---|
| 1,238,831 | 7/1960 | France | 53/162 |

*Primary Examiner*—Travis S. McGehee
*Attorney, Agent, or Firm*—Fleit & Jacobson

[57] ABSTRACT

An assembly of articles are received in a receptacle having a removable base and loaded into a tray disposed beneath the base when the base is removed, the loaded tray being also received on vertically movable support means at an upper position following which the support means are moved selectively into either one lower position for single-stage operation or into two vertically spaced, lower positions successively for a two-stage operation. In the single-stage operation, the support means carrying a single loaded tray is moved into one of the lower positions at which the loaded tray is removed, and in the two-stage operation, the support means carrying a single loaded tray is moved into the other of the lower positions at which a second loaded tray is stacked on the first tray following which the support means is moved into the one lowest position and the two stacked trays are pushed off together.

9 Claims, 7 Drawing Figures

Fig.3
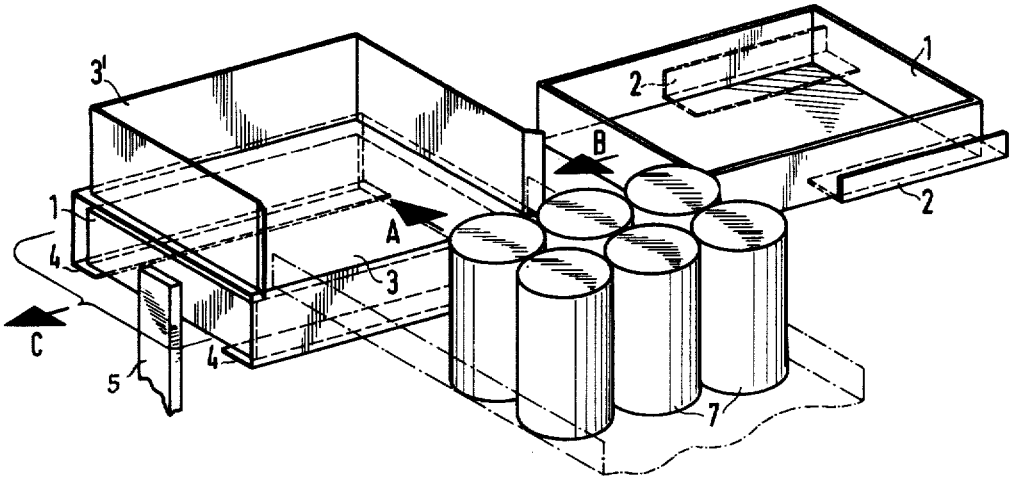
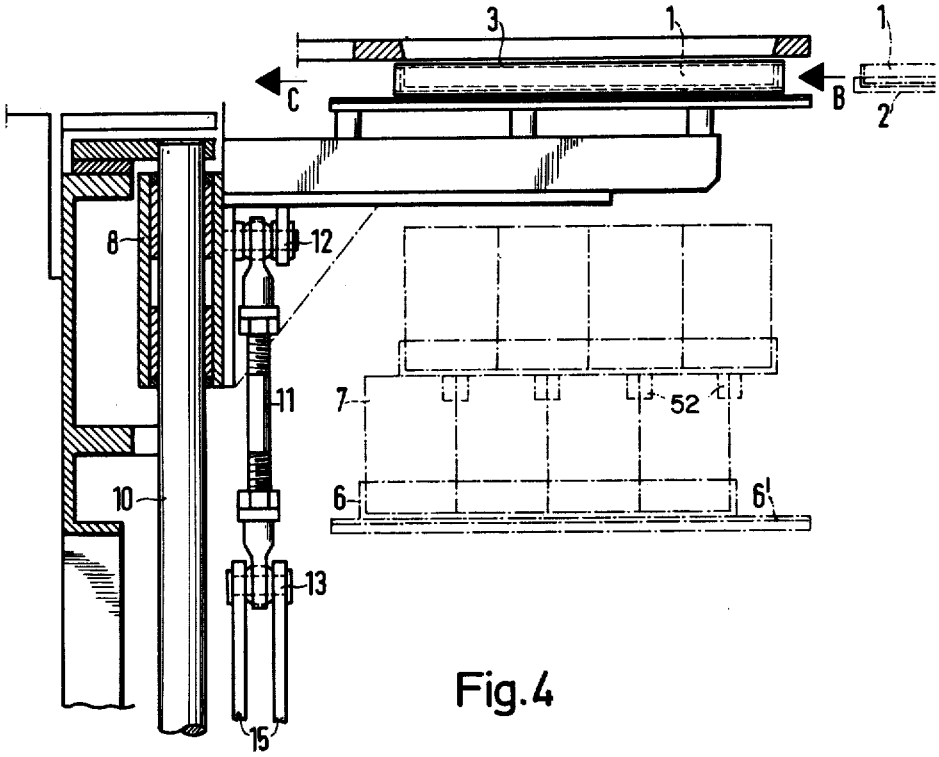
Fig.4

MACHINE FOR FILLING CARRYING TRAYS WITH OBJECTS DISPOSED IN GROUPS

The invention relates to a machine for filling carrying trays with objects, particularly cans, bottles and the like, which are disposed in groups, with a conveying means for feeding the objects, a dropping box with a removable bottom, an apparatus for advancing the carrying trays to a lowerable support disposed beneath the dropping box, and with an arrangement for pushing out the objects deposited on carrying trays disposed on the lower supports. A machine of this type which has proved very satisfactory in practice, is known from German Pat. Specification No. 2,000,264. In the case of this known machine, the objects are continually fed in parallel rows to the filling arrangement in which they collect before abutments. The tightly packed objects are then, in divided groups, pushed into a dropping box, the bottom of which consists of a sliding panel. The sliding panel is then briefly removed so that the objects fall into a carrying tray which is ready beneath the sliding panel and disposed on a lowerable table. The table is then lowered into a second plane in which the tray, with the objects deposited on it, is pushed onto a conveyor or into a machine in which it is provided with a covering of shrinkable plastics film, by which the tray with the objects deposited on it can be shrunk into one compact packaging unit. Since the consumer goods industry requires even more efficient packaging machines with which inexpensive packages can be produced, it is the object of the present invention to increase the efficiency of the known machine while reducing the packaging costs.

In the case of the machine described at the outset, this problem is resolved in that the support can be lowered in two stages, each of which is attuned to the height of the objects to be packed. Using the machine according to the invention, a tray can be filled in known manner with objects and then be lowered to a second stage, the surfaces of the second objects disposed in the lower tray forming a support for a tray deposited thereon and carrying a second filling of objects. From the lowest stage of the lowered support, the two-layered packaging unit is then pushed out and provided with a shrunk-on film covering in known manner. The machine according to the invention results not only in a substantial increase in output by forming a two-layer package but it also results in a saving on shrinkable plastics film amounting to over 25%, since the films enclosing the intermediate layers are unnecessary.

In order that the machine according to the invention may be used optionally for single-layer and two-layer operation, a further development of the invention provides for the lowering of the support to be switchable from single-stage to two-stage operation.

It is ideal for the trays used to have on their underside abutments which extend the side walls beyond the tray bottom, from which the abutments are separated by U-shaped notches, the abutments developing from the bottom as the prepared tray blanks are folded to shape, and being disposed in the plane of the side walls. Through the lateral edges, these abutments grip the objects deposited on the lowest tray and thus secure on the first layer the second layer of the package which is provided by the second tray, so that when the filled trays, stacked one on the other, are fed to the shrinking-on apparatus, slipping is avoided. However, in order to prevent the abutments of the tray deposited on the first layer of the package and engaging over the edge of this first layer, becoming compressed during vertical placement, means are expediently provided for moving the carrying trays with the objects deposited on them in a longitudinal direction by approximately half the width of an object during the first lowering stage. Since the objects to be packed normally consist of cylindrical bodies, this measure avoids a compression of the abutments, because these then fit into the gusset formed between the upright cylindrical members. In order to align the staggered filled trays into an aligned edged stack, adjustable guides are provided which, when the trays are pushed off, move these with respect to one another by the amount by which they are staggered. In this case, the abutments are pushed via the greatest diameter of the objects which are to be packed, so that the second tray becomes anchored on the first filling.

The removable bottom of the dropping box is expediently constructed as a sliding panel having on its underside lateral guides to receive the pushed-in carrying trays which are supplied from a magazine. Since no tray guides can be provided on the first layer of the package, the guides disposed on the sliding panel provide for accurate feeding. During the brief removal of the sliding panel, an abutment prevents the tray being pulled out together with the sliding panel which is beneath the downwardly-falling objects.

Expediently, the support consists of a table movable on vertical guides and capable of being moved by push-rods. The lowerable table can be moved by compressed-air cylinders. However, it is more expedient for the push-rod which moves the table to be driven by a rocker arm driven by a cam drive. The mechanical drive can be more easily adjusted in its height of stroke and adapted to the working rate of the machine. The cam drive expediently consists of a camplate which is in turn driven through a link by a rocker arm. For adjustment as well as for readjustment of the height of lift of the push-rod operated by the rocker arm, the link may be adjustably disposed in an elongated hole in the camplate. It is simple for adjustment in the elongated hole to be effected through a geared transmission. The driving pinion can be connected to an arrangement for indicating the setting of the desired height of lift.

Expediently, the rocker arm which drives the camplate through the link is driven by a second camplate rotating at a uniform speed.

The second camplate is expediently provided on both sides with cams, one of which is intended for single-layer operation while the other is intended for two-layer operation the camplates being engaged by bifurcated means on the rocker arm, on the inner arms of which sliding blocks are disposed, the bifurcated rocker arm being displaceable on its axis for engagement of one slide block in each case into the associated cam. The bifurcated rocker arm can be expediently adjusted on its axis through a spindle drive. When the sliding block is set for two-layer operation, a shift transmission reduces the rotary speed of the drive shaft for the second complate to half that required for single-layer operation, since one revolution of the camplate corresponds to a lowering in two stages, during which, in the working rate of the machine, two layers of goods to be packaged are deposited.

Not all the objects to be packaged can be cleanly deposited in the prepared tray by the gravity principle described. For example, cans of small height have a tendency, when falling onto the panel held ready in the gravity shaft, to lie on one another or to be tilted. Cans of low height are preferably grouped together into two-layer packaging units.

A further object of the invention lies therefore in providing an apparatus which makes it possible also for such packaging goods to be deposited perfectly on a tray held ready in the gravity shaft, and during the free-falling of which trouble was hitherto feared.

In a further development of the invention, this further problem is resolved in that, above the objects pushed into the dropping box, a raisable and lowerable unit is provided to grip them securely and lower into the gravity shaft after removal of the sliding panel, releasing the objects again once they are deposited on the carrying tray disposed in the gravity shaft. By using this arrangement according to the invention, the objects can be deposited in an accurately defined manner on the prepared carrying tray.

If the objects which are to be packaged are ferromagnetic then the raisable and lowerable holding means may consist of a vertically guided magnetic plate. The magnetic plate may be provided with permanent magnets, anti-ferritic rods traversing the magnetic plate in order to push the deposited objects off the magnets. The magnetic plate may also comprise electromagnets, the magnetising current of which is broken after the objects have been deposited. Finally, the raisable and lowerable holding means may also have suction or gripping means. Suitable suckers are suction cups or suckers connected to a vacuum force.

By way of example, an embodiment of the invention is described in greater detail hereinafter with reference to the attached drawings, in which:

FIG. 3 is a diagrammatic view of the paths for feeding to the dropping box the objects which are to be packaged and the trays;

FIG. 4 is a side view of the lowerable table shown in FIG. 1;

Figure 1:
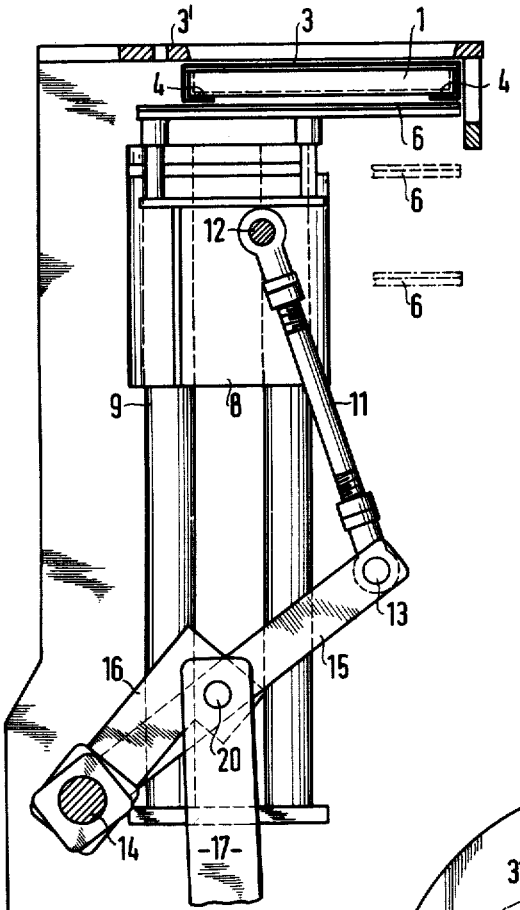
FIG. 1 shows the slides for guiding the lowerable table, with its drive.
Figure 2:
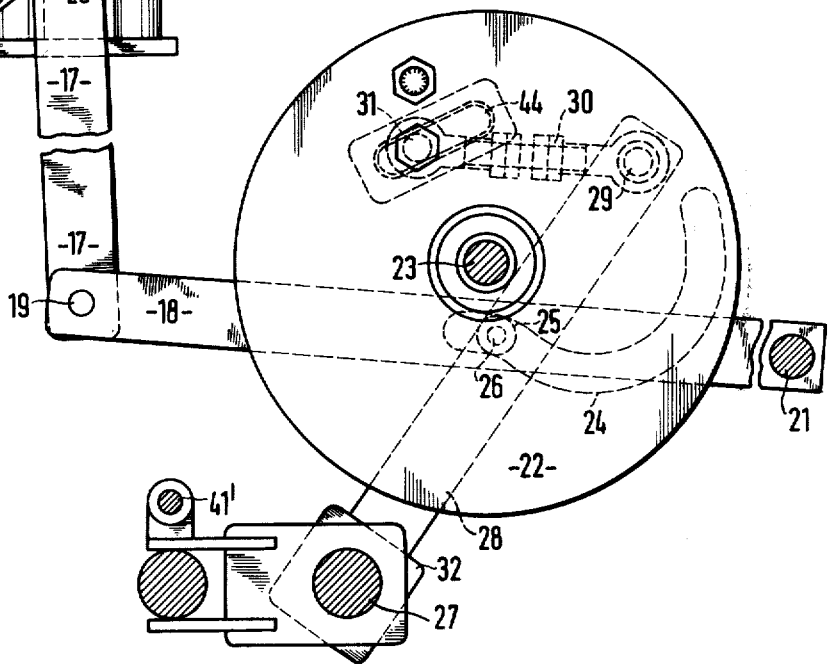
FIG. 2 shows the drive of the push-rod for moving the lowerable table, in a view rotated through 90° with respect to FIG. 1.

The process by which cylindrical objects 7 are filled into trays 1 is explained with reference to FIG. 3. A conveying means, not shown, pushes the objects 7, arranged in parallel rows, in the direction of the arrow A in known manner onto the sliding panel 3, on which they are secured in their position with respect to one another by the U-shaped frame 3' disposed rigid with the machine. The sliding panel 3 has on its sides, formed by U-shaped angled portions, guides and supports 4, into which, in the direction of the arrow B, the trays 1 supplied over guides 2 by a magazine, not shown, can be pushed. Closely beneath the guides 4 for the trays 1 is the lowerable table 6. After one layer of objects 7 have been pushed into the dropping box formed by the frame 3' and the sliding panel 3, the sliding panel 3 is briefly extended outwards in the direction of the arrow C so that the tray which is braced against the abutment 5 rigid with the machine, cannot follow the extending movement, so that the objects 7 fall into the tray exposed by the sliding panel 3 and are deposited on the table 6 together with the tray.

Figure 5:
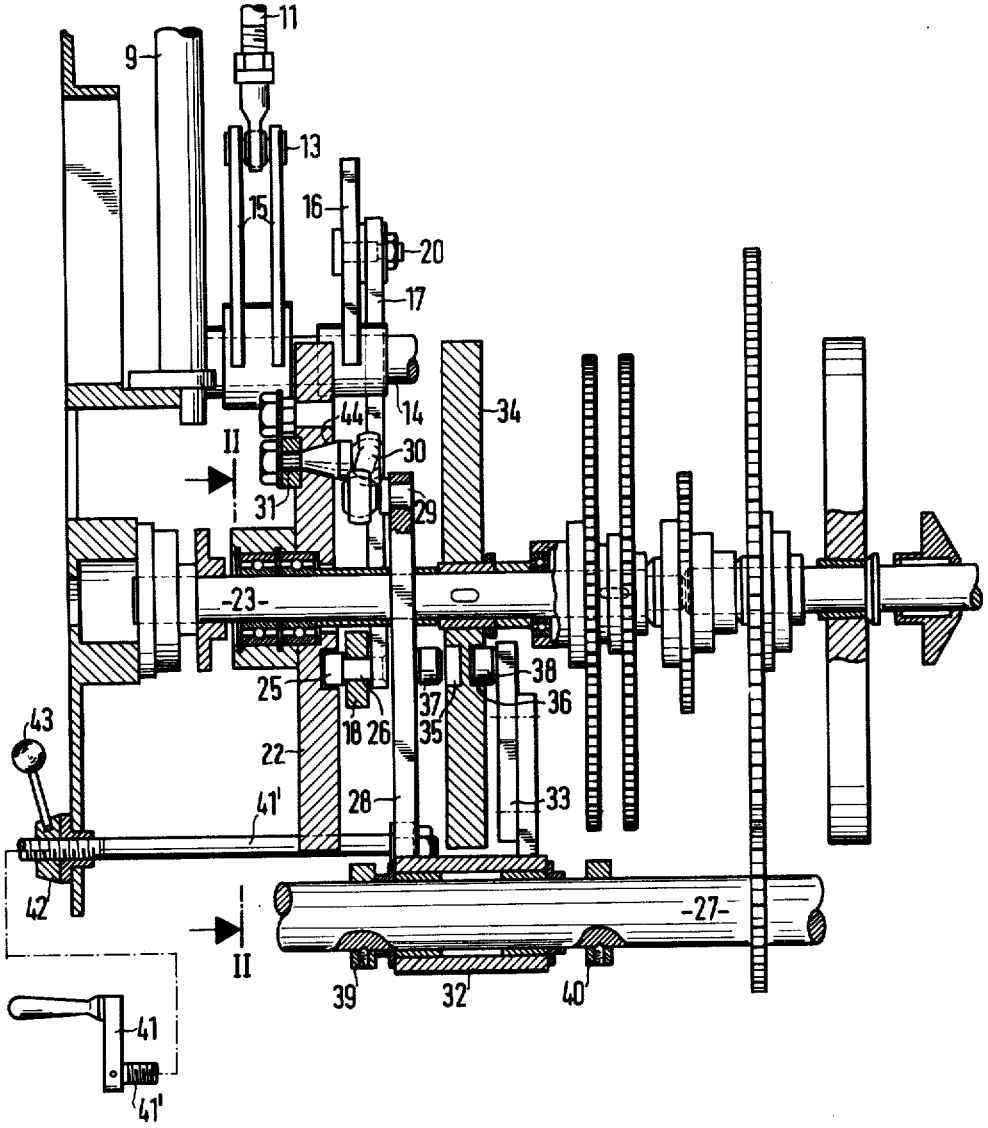
FIG. 5 is a section through the drive shown in FIG. 3.

The table 6 is mounted on a supporting member 8 which is guided to slide on the columns 9, 10. The supporting member 8 has an eye-shaped bearing 12 at which the push-rod 11 is articulated, the other end of the push-rod 11 being articulated through the eye-shaped bearing 13 on the bifurcated rocker arm 15, the other end of which is rigidly connected to the shaft 14 mounted in the machine frame. The shaft 14 also carries, disposed at a distance from the rocker arm 15, a rocker arm 16 (FIGS. 1 and 5) with the free end of which the push-rod 17 is connected, at the joint 20, its other end being articulated by the joint 19 on the rocker arm 18 which is mounted to pivot about a bearing 21 rigid with the machine. The lowerable table 6 is thus driven through a gear transmission with six joints 21, 19, 20, 14, 13, 12. The rocker arms 15, 16 mounted on the shaft 14 which is mounted in the machine frame serve only to increase the travel, so that the push-rod 11 could also be articulated directly on the rocker arm 18 if this latter is constructed for a sufficiently wide pivoting angle.

The rocker arm 18 is pivoted by the camplate 22 with its integral cam 24 and which is mounted for free rotation on the drive shaft 23. For this purpose, the slide block 25 mounted on the rocker arm 18 by the bolt 26 slides in the curve or cam pattern 24.

For its part, the camplate 22 is driven by the rocker arm 28 which is pivotable about the axis 27, rigid with the machine, through the link 30 which is articulatingly connected to the eye-shaped bearing 29 with the rocker arm 28 and by the eyeshaped bearing 31 with the camplate 22. The rocker arm 28 is mounted on a bush 32 which is rotatably and longitudinally displaceably mounted on the spindle 27. Secured on the bush 32 is a second rocker arm 33, the rocker arms 28 and 33 engaging in bifurcating fashion around the camplate 34. The camplate 34 is mounted on the drive shaft 23 which is drivingly connected to the main machine drive. The camplate 34 has, machined onto its two sides, curved grooves, of which curve 35 serves for two-layer operation while curve 36 serves for single-layer operation. Secured to the rocker arm 28 is a sliding block 37 which, for two-layer operation is displaced into the curve 35 by movement of the bush 32 which carries the rocker arm 28. If the sliding block 37 is pushed into the curve 35, then at the same time, the sliding block 38 which is mounted on the rocker arm 33, is pushed out of the curve 36 for single-layer operation.

The extreme positions of the displaceable bush 32 are fixed by the abutments 39, 40 which are rigidly disposed on the spindle 27. The spindle 41' for displacement of the bush 32 is actuated via the crank 41. The spindle 41' can be locked and released by means of the nut 42 which is to be operated by the hand lever 43.

The eye-shaped bearing 29 and 31 of the link 30 are so constructed that they can compensate for displacement of the mountings by movement of the bush 32.

The eye bearing 31 is displaceable in the elongated hole 44 provided in the camplate 22. Displacement can thereby be effected by a rack and a drive. The drive pinion being possibly provided with a pointer to indicate the height of lift which has been set. The elongated hole 44 is so provided in the camplate 22 that by adjusting the eye-shaped bearing 31 in this elongated hole, the angle of rotation of the camplate 22 can be increased or decreased according to the height of lift of the table 6 which is required.

On the righthand side of FIG. 4, the table 6 is shown in its lowest position 6', with objects 7 deposited on it in two layers, on trays. The upper tray is staggered by half the width of a can on the lower layer of objects (for example cans), in such a way that the abutments 52 which are a prolongation of the tray edge, rest in the gussets formed between the individual cans. Upon the two layers of cans, deposited on trays, being pushed out, guides which are not shown in greater detail are provided for pushing the trays onto one another so that the offset is eliminated, and ensuring that the abutments 52 are pushed over the largest diameters of the goods deposited on the lower tray.

Figure 6:
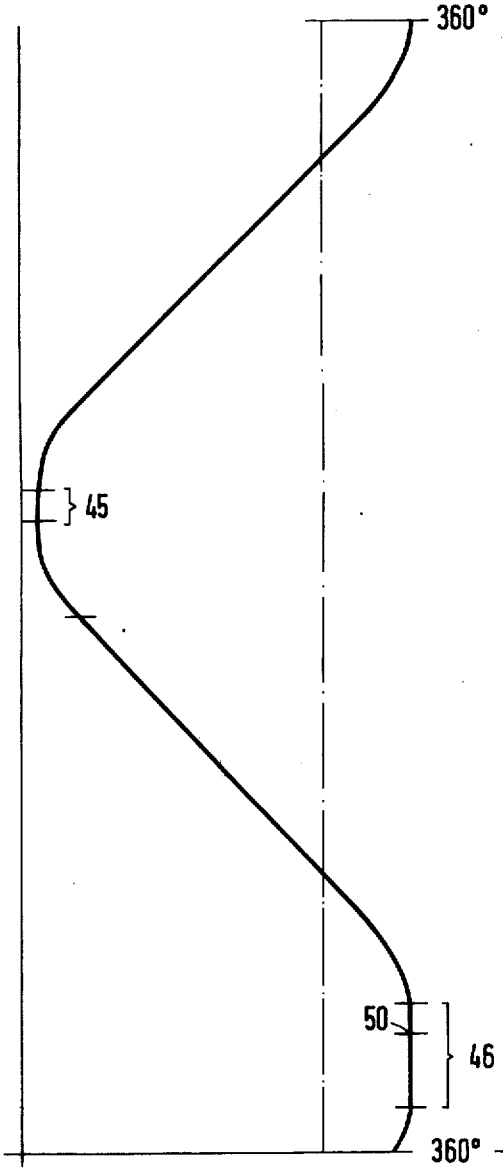
FIGS. 6 and 7 show the control cams for the lowerable table in single-layer and double-layer operation.
Figure 7:
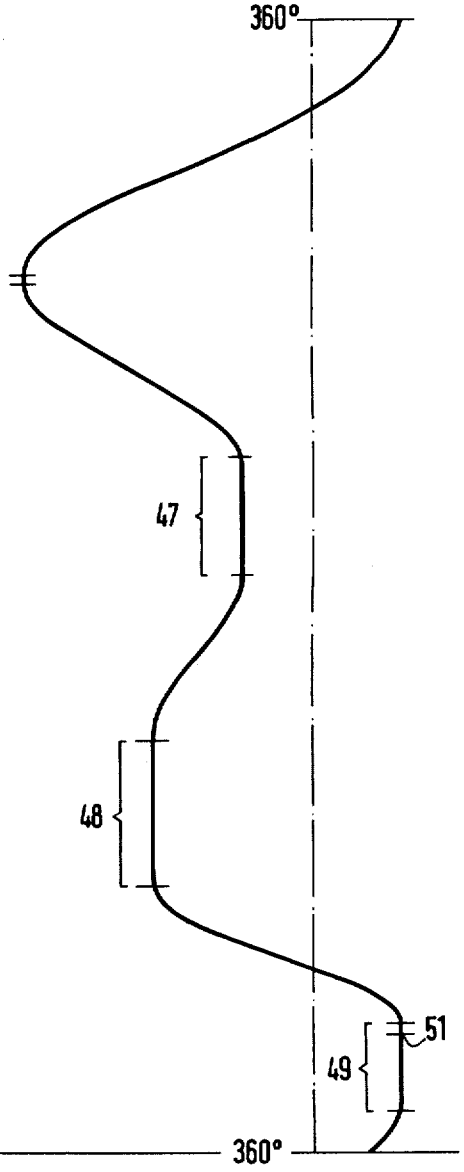

FIGS. 6 and 7 show control cams for single-layer and two-layer operation respectively. In these diagrams, the travel of the table 6 is plotted with respect to the angle of rotation of the camplate 34 for an extended apparatus. The diagram in FIG. 6 shows the control cam for single-layer operation. At the point 45, the table is in its upper position. In this position, the trays and the objects which are to be packaged are deposited on the table 6. In the lower position 46, the tray is pushed out with the objects deposited on it.

The diagram in FIG. 7 shows the control cam for two-layer operation, the characteristics of which will be manifest from the pattern of curve 35 on the camplate 34. The straight portion 47 denotes a rest following the first lowering stage, the straight portion 48 shows the rest for filling of the second layer and at the point 49, the two-layer package unit is pushed out. At the points 50, 51, the corresponding parts of the two curves 35 and 36 on the camplate 34 coincide, so that it is at this point that the equipment can be changed over from two-layer to single-layer operation and vice versa.

The height of lift of the rest points for two-layer operation can be infinitely variably adjusted by adjusting the eye-shaped bearing 31 in the elongated hole 44 in the camplate 22.

I claim:

1. A machine for loading an assembly of articles such as cans or the like onto trays, comprising in combination, a receptacle having a removable base and a side wall therefor for receiving said assembly of articles, means associated with said receptacle for guiding said assembly of articles into said receptacle in supported relationship on said base, means for supporting a tray in underlying relationship with said base, means for moving a tray onto said tray supporting means into said underlying relationship with said base whereby said assembly of articles is deposited in said tray upon removal of said base, vertically movable tray support means movable into an upper position beneath said receptacle for supportedly receiving a tray loaded with said assembly of articles upon removal of said base and into two vertically spaced lower positions and drive means for moving said support means reciprocally between said upper position and selectively into either one of said lower positions for removal of a single loaded tray from said support means in a single-stage operation or into both of said two lower positions successively for receiving a second loaded tray in stacked relationship with the first loaded tray and for removal of said stacked trays from said support means in a two-stage operation.

2. A machine in accordance with claim 1, wherein said drive means includes means for guiding said support means during said vertical movement, a driving cam, means for rotating said driving cam, a drive rocker arm operatively connected to said driving cam and linkage means including a push-rod connected between said rocker arm and said support means.

3. A machine in accordance with claim 2, wherein said drive means include means for converting said drive means selectively for said single-stage operation or said two-stage operation.

4. A machine in accordance with claim 3, wherein said driving cam comprises a rotatably mounted cam plate having a cam slot, a cam follower on said rocker arm slidably engageable with said driving cam slot and wherein said converting means include means for adjusting said driving cam rotating means.

5. A machine in accordance withh claim 2, wherein said means for rotating said driving cam includes a rotatably driven cam plate having a cam track on each side face, a first rocker arm having a cam follower arranged for slidable engagement with one of said cam tracks, a second rocker arm having a cam follower arranged for slidable engagement with the other of said cam tracks, means for drivably connecting one of said first and second rocker arms to said driving cam, means for interconnecting said first and second rocker arms for movement of said rocker arms between first and second positions for selective engagement of one of said cam followers with its associated cam track, means for moving said rocker arms between said first and second positions whereby engagement of said cam follower of said first rocker arm with its associated track conditions said driving cam rotating means for said single-stage operation and whereby engagement of said cam follower of said second rocker arm with its associated track conditions said driving cam rotating means for said two-stage operation.

6. A machine in accordance with claim 5, wherein said means for drivably connecting one of said first and second rocker arms to said driving cam include a coupling member and means for adjustably connecting the ends of said coupling member to said one rocker arm and said driving cam.

7. A machine in accordance with claim 6, wherein said connecting means include a slot on said driving cam for adjustably connecting one end of said coupling member to said driving cam for adjusting the vertical position of said support means in each of said lower positions.

8. A machine in accordance with claim 5, wherein said means for interconnecting said first and second rocker arms include a sleeve member arranged for axial displacement between said first and second positions, said first and second rocker arms being mounted at one end on said sleeve and including a spindle connected to said sleeve for moving said sleeve axially between said first and second positions for selective engagement of said cam followers on said first and second rocker arms with their associated cam tracks.

9. A machine in accordance with claim 1, wherein said receptacle removable base comprises a panel having side edges and wherein said means for supporting a tray in underlying relationship with said base includes a downwardly depending flange on opposite side edges of said panel for slidably accommodating said tray and including abutment means adjacent said receptacle for engagement with a tray disposed in underlying relationship with said panel to retain said tray when said base is removed.

* * * * *